US007709720B1

(12) United States Patent
Shippey et al.

(10) Patent No.: US 7,709,720 B1
(45) Date of Patent: May 4, 2010

(54) TUNER GUARD

(75) Inventors: James D. Shippey, 32 Noble St., Newton, MA (US) 02465; Kenneth P. Smith, 120 Nason Hill Rd., Sherborn, MA (US) 01770; Anthony Manbucca, Hopedale, MA (US)

(73) Assignees: James D. Shippey, Newton, MA (US); Kenneth P. Smith, Sherborn, MA (US)

( * ) Notice: Subject to any disclaimer, the term of this patent is extended or adjusted under 35 U.S.C. 154(b) by 0 days.

(21) Appl. No.: 12/387,147

(22) Filed: Apr. 28, 2009

Related U.S. Application Data

(60) Provisional application No. 61/126,119, filed on Apr. 30, 2008.

(51) Int. Cl.
*G10D 3/00* (2006.01)

(52) U.S. Cl. ..... 84/453; 84/454; 84/327; 84/329

(58) Field of Classification Search ..... 84/453, 84/554, 327, 329
See application file for complete search history.

(56) References Cited

U.S. PATENT DOCUMENTS

| | | | | |
|---|---|---|---|---|
| 3,329,054 | A * | 7/1967 | Faillaci | 84/267 |
| 6,600,096 | B2 * | 7/2003 | Jarvis | 84/453 |
| 7,462,769 | B2 * | 12/2008 | Kilpatrick | 84/329 |
| 7,569,759 | B2 * | 8/2009 | Pace et al. | 84/453 |
| 2005/0145095 | A1 * | 7/2005 | Larry | 84/453 |
| 2008/0216633 | A1 * | 9/2008 | Winch | 84/329 |
| 2009/0013853 | A1 | 1/2009 | Pace et al. | |

OTHER PUBLICATIONS

The Music People! Inc., "Stocker The Only Guitar Headstock Protector", http://www.musicpeopleinc.com/stocker, May 2009, printed Jul. 22, 2009, 1 page.
The Music People! Inc., "Stocker™ The Ultimate Headstock Protector", TMP Pro Distribution, http://www.pacerconcepts.com/html/news.html, no publication date, printed Jul. 22, 2009, 3 pages.
The Music People! Inc., "Stocker™ The Ultimate Headstock Protector", TMP Pro Distribution, http://www.pacerconcepts.com/, no publication date, printed Jul. 22, 2009, 2 pages.
The Music People! Inc., "Stocker™ The Ultimate Headstock Protector", TMP Pro Distribution, http://www.pacerconcepts.com/html/specs.html, no publication date, printed Jul. 22, 2009, 4 pages.

* cited by examiner

*Primary Examiner*—Jeffrey Donels
*Assistant Examiner*—Robert W Horn
(74) *Attorney, Agent, or Firm*—Muirhead and Saturnelli, LLC

(57) ABSTRACT

Described are techniques for preventing movement of tuning pegs on a stringed instrument. Described is a device comprising an elongated body forming a sleeve opened at a first end thereof and having a slit formed therein. The body has a shape and dimensions in accordance with a shape and dimensions of a row of a plurality of tuning pegs of the stringed instrument so that the body is configured to enclose therein head portions of the plurality of tuning pegs. The slit is configured to have a length and width to extend around neck portions of the plurality of tuning pegs on the stringed instrument.

18 Claims, 14 Drawing Sheets

100
100b
11

(outside view)
100b
102

(side that slides inward closest to the tuning peg base)
102
10c
10a

TUNER GUARD

CROSS REFERENCE TO RELATED APPLICATIONS

This application is based on U.S. Provisional Patent Application No. 61/126,119, filed on Apr. 30, 2008, which is incorporated by reference herein.

BACKGROUND

1. Technical Field

This application generally relates to musical instruments, and more particularly to stringed musical instruments.

2. Description of Related Art

Stringed instruments, such as those in the guitar family, may be tuned by varying the tension of strings through rotational movement of tuning pegs or keys connected to the strings. Once a stringed instrument has been tuned so that the tuning pegs have a desired setting, the instrument may be transported, stored in a soft-sided case, and the like. The tuning pegs or keys of the stringed instrument may be subjected to inadvertent movement subsequent to tuning causing an undesirable change to the previous tuning settings. Thus, it may be desirable to utilize a technique to prevent the foregoing unintentional modification of tuning settings of the stringed instrument.

SUMMARY OF THE INVENTION

In accordance with one aspect of the invention is a device for preventing movement of tuning pegs on a stringed instrument. The device comprises an elongated body forming a sleeve opened at a first end thereof and having a slit formed therein. The body has a shape and dimensions in accordance with a shape and dimensions of a row of a plurality of tuning pegs of the stringed instrument so that the body is configured to enclose therein head portions of the plurality of tuning pegs. The slit is configured to have a length and width to extend around neck portions of the plurality of tuning pegs on the stringed instrument. The body may be enclosed at a second end thereof opposite said first end. The body may have a cross-sectional profile which is one of generally circular or elliptical. A portion of the slit may be tapered to increase in width for a length of the portion extending from a first point in the slit to said first end. The length of the portion of the slit which is tapered may be approximately 1 inch. The width of the portion at the first point may be approximately 0.24 inches. The slit may be configured with a malleable material running the length of the slit at an inner portion of the slit. The malleable material may be in contact with the tuning pegs of the stringed instrument when the device is installed on the stringed instrument. The body may be open at a second end thereof opposite the first end. The device may further comprise a plurality of pairs of feet extending from the body. The plurality of pairs of feet may be configured to have bottom portions which are substantially in a same plane. Each of the plurality of pairs of feet may be spaced approximately equidistant from one another. The device may be made of one or more materials including a thermo-plastic elastomer. A wall of said body may include a first portion extending from a first point to a second point at an edge of said slit, and the wall may decrease in thickness from said first point to said second point. A thickness of said wall at said first point may be approximately 0.10 inches and a thickness of said wall at said second point may be approximately 0.06 inches. The wall may include the first portion with respect a first edge of said slit and said wall may include a second portion with respect to a second edge of said slit opposing said first edge, said second portion extending from a third point to a fourth point at said second edge of said slit, wherein said wall may decrease in thickness from said third point to said fourth point, a thickness of said wall at said first point and said third point may be approximately the same and a thickness of said wall at said second point and said fourth may be approximately the same. The wall may have approximately a uniform thickness except for said first portion thereof and said second portion thereof. The length of the slit may be less than a length of said body. The device may have a hardness in accordance with a durometer reading of between 75 and 90, inclusively.

BRIEF DESCRIPTION OF THE DRAWINGS

Features and advantages of the present invention will become more apparent from the following detailed description of exemplary embodiments thereof taken in conjunction with the accompanying drawings in which.

DETAILED DESCRIPTION OF EMBODIMENT(S)

Described in following paragraphs are techniques that may be used in connection with stringed instruments, such as those of the guitar family, to prevent unintentional or other undesired movement of tuning pegs causing a variation to existing tuning settings. A stringed instrument, such as a guitar, may be tuned by rotating the tuning pegs connected to the strings to desired positions. The rotational position of the tuning pegs may be referred to as a tuning setting. Subsequently, the tuned stringed instrument may be stored in a soft-sided case and/or transported. During this time, the instrument may be subjected to conditions which undesirably alter the tuning settings through rotational movement of one or more of the tuning pegs. Movement of the tuning pegs or keys varies the tension of the strings connected to the tuning pegs and may cause an unwanted variation to the tuning settings. As such, described herein are techniques that may be used in connection with preventing the accidental alteration of tuning settings on guitars and other stringed instruments during transport and storage particularly in "gig bag" style soft cases and other situations where the unprotected tuning keys are vulnerable to unwanted change of position.

It should be noted that in following paragraphs, examples are set forth and may make reference to a particular stringed instrument, such as a guitar with a particular number of tuning pegs. However, it will be appreciated by those skilled in the art that the techniques described herein have more generally applicability and should not be construed as limited to particular examples used for purposes of illustration.

Described herein are various embodiments of a device that, when slipped over the tuning peg or key heads of a stringed instrument, prevents the unintentional turning of the tuning pegs, and thus, prevents alteration to tuning settings. In following paragraphs, the device may be referred to as a tuner guard.

Figure 1:
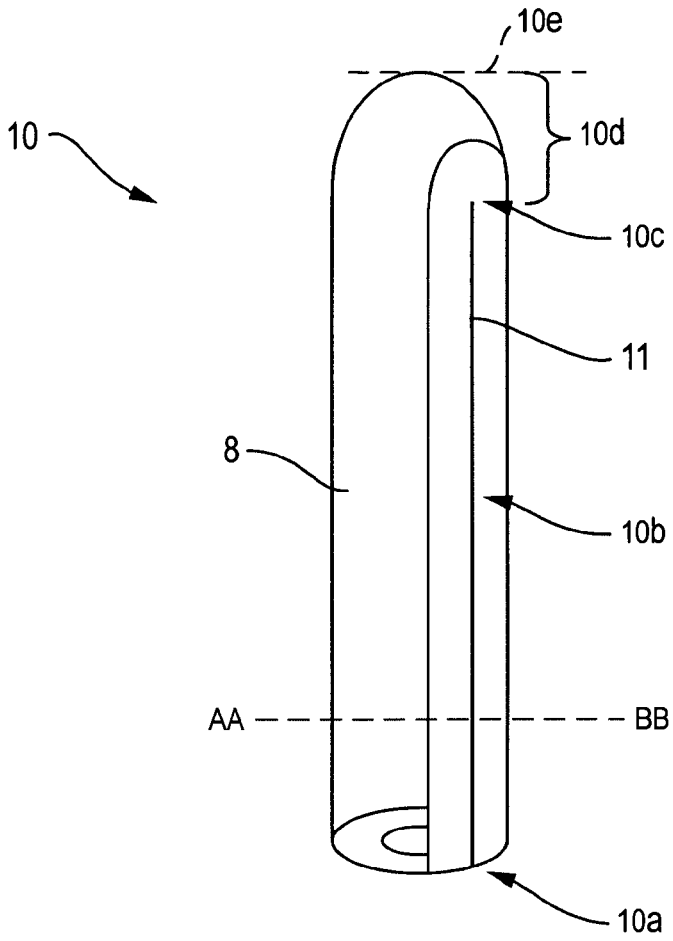
FIG. 1 is an example of an embodiment of a tuner guard.

Referring to FIG. 1, shown is an example of one embodiment of the tuner guard. The example 10 shows a transparent single tuner guard in the form of an enclosed tube in an upright position while not in use with the stringed instrument. As described in following paragraphs, the tuner guard 10 may be positioned in line with a row of tuning pegs. The tuner guard 10 may then be moved in a linear direction from 10*a* to 10*c* to install or place the tuner guard in use with a stringed instrument resulting in the illustration of FIG. 2.

The example 10 of FIG. 1 illustrates a tuner guard with a slit 11 along a surface of the tuner guard. The slit 11 provides an opening through an outer surface to the inner surface of one of the sidewalls of the tuning guard. Element 10*a* indicates one end of the slit 11 where the tuner guard is intended to first encounter the uppermost tuning peg on either side of the stringed instrument. Element 10*b* represents the entire shaded portion of the tuner guard illustrated. The portion 10*b* may be made of a malleable material, such as a rubber material, latex, plastic or other form-fitting or malleable material, to allow the tuner guard to posses a "sticky" or friction quality while in use. As illustrated, the portion 10*b* formed of the rubber type or other material has a slit 11 that runs the length of the tuning pegs when the tuner guard is slid onto and over the pegs in its installed position. Element 10*c* indicates another end of the slit 11 opposite that indicated by 10*a*. Element 10*c* may represent a position where the uppermost tuning peg may reside while the tuner guard is in use and engages the tuning pegs of a stringed instrument. The slit 11 may have a length selected in accordance with the length associated with the distance between tuning pegs to be protected using the tuner guard.

The tuner guard body 8 may be formed from a plastic or other equivalent material with a circular opening at one end 10*a* and having a portion 10*b* as described above made of a rubber or other malleable material. The tuner guard body may be illustrated herein for exemplary purposes as transparent although the tuner guard may be transparent, translucent, or otherwise opaque or made of a variety of different colors.

An embodiment may manufacture each of the tuner guard tubes as illustrated in FIG. 1 as a single unit with an opening on a side corresponding to the location at which the portion 10*b* is located. The material of portion 10*b* may then be placed into the opening in the tuner guard tube. Using the material forming portion 10*b*, the tuner guard tube may be held in position and secured to the tuning pegs being protected. It should be noted that the portion 10*b* may also be referred to herein as an insert portion with the slit 11 formed therein. The portion 10*b* may be secured to the body 8, for example, using an adhesive. It should also be noted that, depending on the material(s) comprising portion 10*b* and/or the size of the opening in the body 8 including portion 10*b*, use of an adhesive or other additional means to secure the portion 10*b* in the body 8 may be unnecessary and omitted. That is, the portion 10*b* may remain secured to the body 8 without the need for adhesive based on the design of the portion 10*b* alone. For example, the portion 10*b* may be made of a malleable material which is inserted into an opening down the side of the body 8 as illustrated in FIG. 1. The opening may be made or otherwise formed in the body 8 to receive the portion 10*b* so that there is no slippage of portion 10*b* once inserted unless force is used to remove portion 10*b* such as by pulling.

Figure 2:
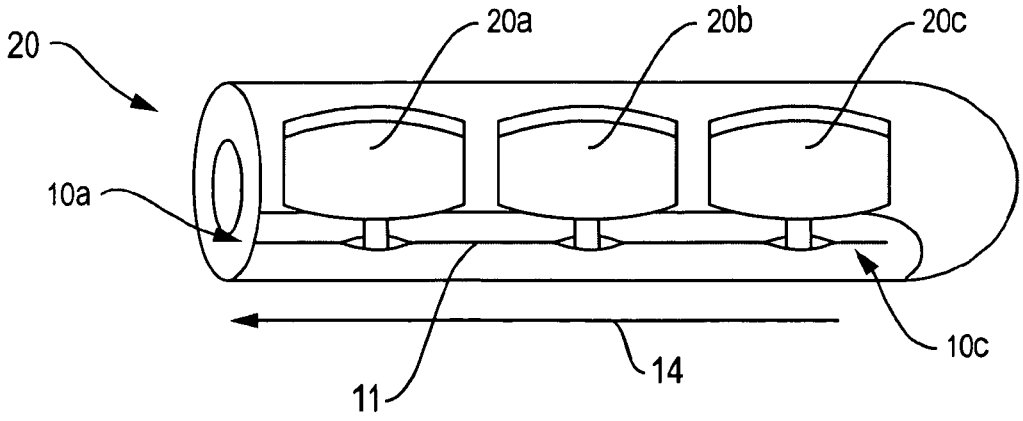
FIG. 2 is an example of an embodiment of a tuner guard installed and in use with a stringed instrument.

Referring to FIG. 2, shown is an example illustrating a transparent view of the single tuner guard from FIG. 1 when engaging tuning pegs of a stringed instrument. The example 20 illustrates the tuner guard of FIG. 1 protecting 3 tuning pegs 20*a*-20*c* when the tuner guard is installed for use with the stringed instrument pegs. It should be noted that, as with FIG. 1, the tuner guard body is shown is being transparent for purposes of illustration only. In an embodiment in which the tuner guard body is not transparent, the pegs 20*a*-20*c* are enclosed within the body and are thus not viewable in the position illustrated in FIG. 2. An embodiment of the tuner guard may be used with any number of tuning pegs and may have a length suitably selected for use with the number of tuning pegs protected. Element 10*a* illustrates the end of the slit 11 where the tuner guard is first slid onto and over the pegs 20*a*-20*c* in a linear direction 14. With the stringed instrument and tuning pegs remaining stationary, the tuner guard slit 11 is linearly aligned with the tuning pegs 20*a*-20*c*. In particular, the slit end 10*a* is first positioned near peg 20*c*. The tuning guard may then be moved in a linear direction 14 so, in order, tuning pegs 20*c*, 20*b*, and 20*a* are engaged by the tuner guard within the slit 11. When desired, the tuning guard may be removed by moving the tuning guard tube in a direction opposite to that indicated by arrow 14.

It should be noted that the tuning pegs 20*a*-20*c* are illustrated in the example 20 inside the tuner guard. The tuning pegs are typically attached to the stringed instrument, however only the pegs themselves are shown in this example for the purpose of illustration. While in use, the tuner guard virtually eliminates the possibility of the tuning pegs from being moved or turned. This prevents the instrument from going out of tune and protects the stringed instrument from any damage that may result from accidental contact with other objects or persons while in storage and/or transport.

FIGS. 1 and 2 illustrate one exemplary embodiment of the tuner guard formed from an enclosed tubular shaped body with an inner diameter slightly larger in diameter than the tuning peg head and a length slightly longer than the maximum cumulative dimension of the peg heads with relation to each other laterally. With reference back to FIG. 1, the embodiment of the tuner guard has a slit 11 extending from the one end 10*a* of the tuner guard to a point on the device 10*c* where the remaining length 10*d* may not contain the slit therethrough. The slit 11 may have an opening width selected in accordance with the size of the neck portion of the tuning pegs engaged by the slit 11 and the material comprising portion 10*b*.

As a variation to the foregoing, the end 10*e* may be open rather than enclosed with the length of the tuner guard sufficient to protect the last tuning peg 20*c*. Also, although the tuner guard body 8 is shown as having a rounded end 10*e* in FIG. 1, the tuner guard body may also have other shapes such as, for example, a flat end portion 10*e* that may be open or enclosed.

Figures 3A, 3B, 3C:
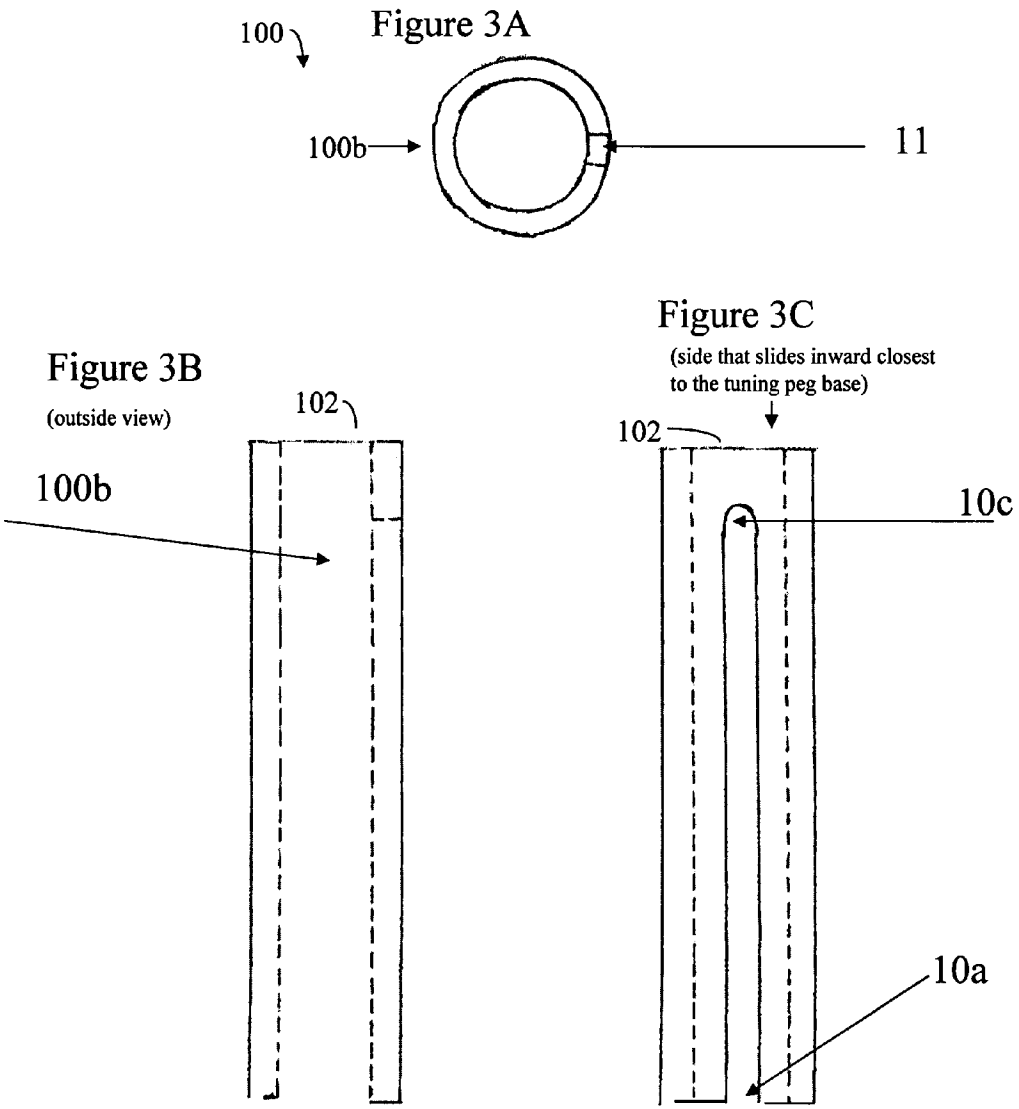
FIGS. 3A, 3B and 3C illustrate different views of the embodiment of the tuner guard of FIG. 1.

Referring to FIG. 3A, shown is a cross-sectional view of the embodiment of the tuner guard as illustrated in FIG. 1 while not in use with a stringed instrument taken along line AA-BB of FIG. 1. The example 100 illustrates the slit opening 11 formed through a surface of the tuner guard. FIG. 3B illustrates a first or outside view of the tuner guard of FIG. 1 when viewing the tuner guard from position 100*b* opposite from the tuner guard surface containing the slit 11. FIG. 3C illustrates a second or underside view of the tuner guard of FIG. 1 when viewing the tuner guard surface containing the slit 11. Element 10*c* makes reference to the position of the uppermost tuning peg once the tuner guard is installed for use with a stringed instrument. Element 10*a* shows the bottom opening of the slit which enables the tuner guard to be slid onto the tuning pegs (not illustrated). It should be noted that the tuner guard body in FIGS. 3B-3C is shown as having a flat end 102 rather than a rounded end as illustrated, for example, in FIGS. 1 and 2. However, as described above, the end 102 may be flat, rounded, and enclosed or open at the end.

Figure 3E:
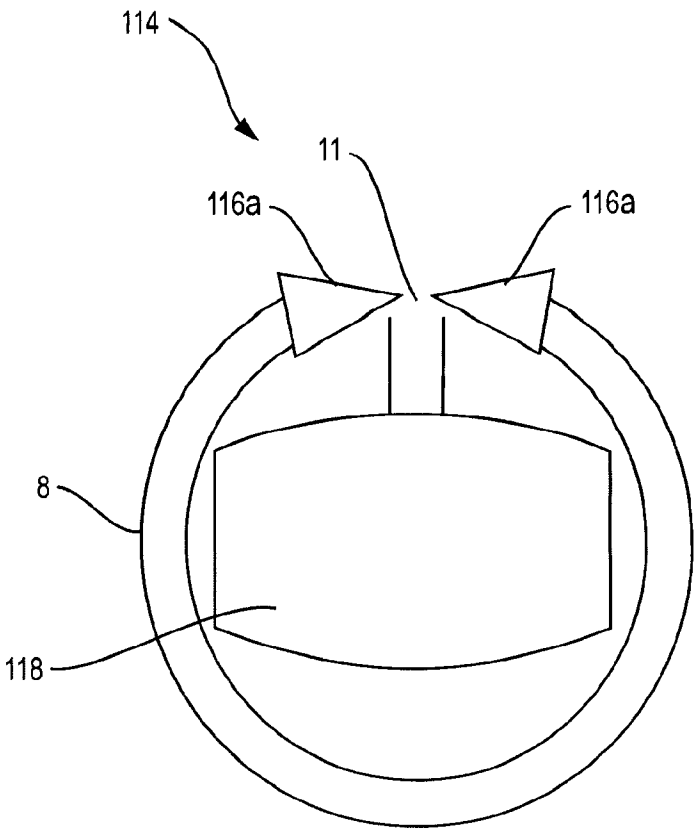
FIG. 3E is a cross section view of an embodiment of the tuner guard illustrating in more detail the insert portion.
Figure 3D:
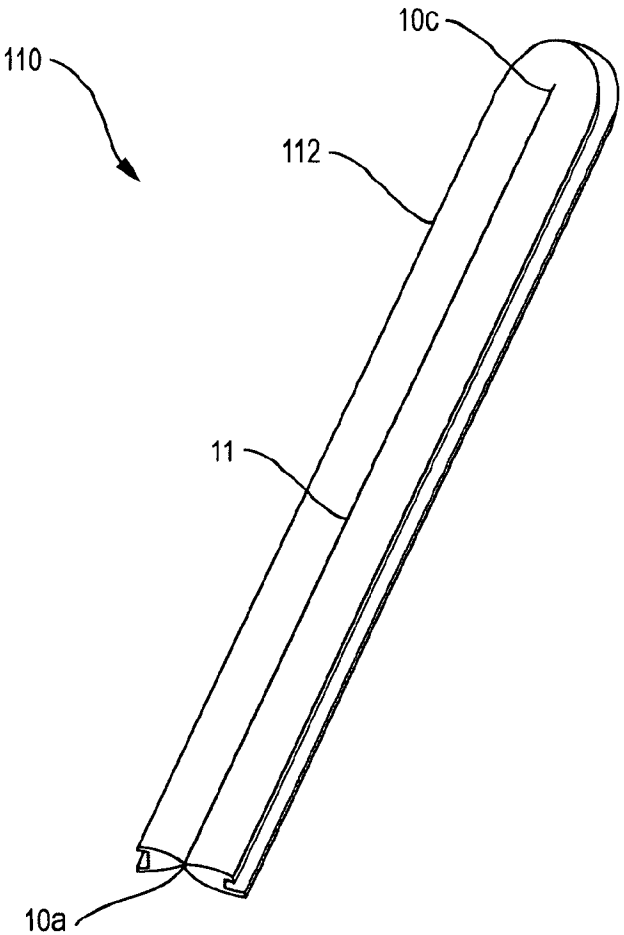
FIG. 3D illustrates in more detail an insert portion as may be used in an embodiment of the tuner guard.

Referring to FIG. 3D, shown is an example illustrating in more detail the insert portion as may be included in an embodiment of the tuner guard. The example 110 illustrates in more detail element 10*b* of FIG. 1. The example 110 shows insert portion 112 including a slit 11 having ends 10*a* and 10*c*. As described elsewhere herein, the tuner guard may be slid onto the tuning pegs by introducing the tuning pegs into the slit 11 at end 10*a* so that, in the installed position, the first peg introduced into the slit 11 resides at a position indicated by 10*c*.

Referring to FIG. 3E, shown is a cross section view of an embodiment of the tuner guard illustrating in more detail the insert portion including a slit formed therein when installed over a tuning peg. The example 114 includes a tuner guard body 8 and illustrates the sides 116*a* of the insert portion with the slit 11 formed therein when installed over the tuning peg 118.

Figure 4A:
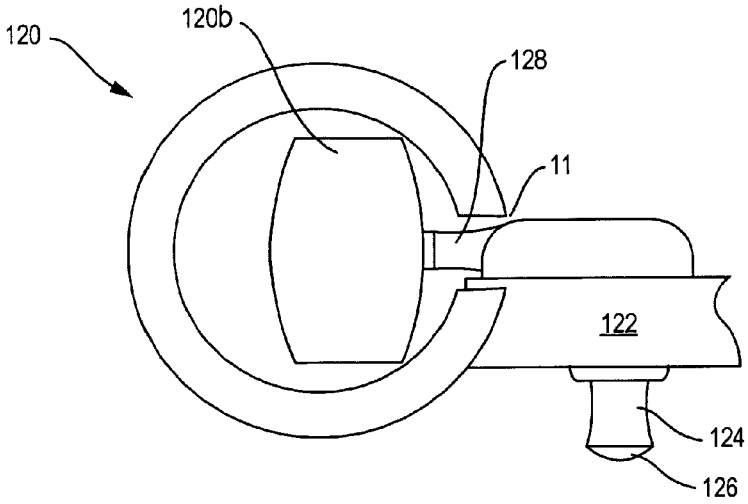
FIGS. 4A, 4B and 4C illustrate different views of the embodiment of the tuner guard of FIG. 2 in use with a stringed instrument.

Referring to FIG. 4A, shown is an example of a cross-sectional view of both the tuner guard (as illustrated in FIG. 3A) and one tuning peg while the tuner guard is installed on the stringed instrument. The example 120 illustrates the slit 11 into which the tuning peg 120*b* is inserted. The neck portion 128 of the tuning peg is in contact with the material in the slit 11 so that the material comprising the slit 11 conforms around the outer surfaces of the neck portion 128. Element 122 represents the guitar neck having through holes formed therein into which the tuning pegs are inserted. Element 124 represents an opening in the tuning peg through which a string may be coupled to the peg. Element 126 represents a surface of the tuning peg. The example 120 shows the tuning peg 120*b* in one of its adjusted positions while being protected by the tuner guard. In this example and angle of perspective, the tuning peg 120*b* appears to be flat displaying the most surface area possible of a surface of the tuning peg head.

Figure 4B:
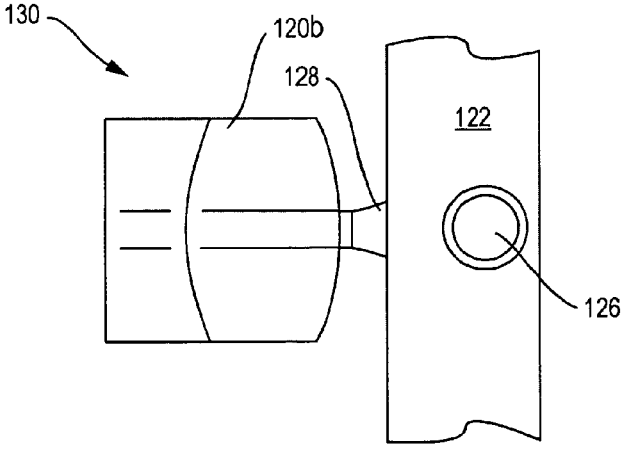
Figure 4C:
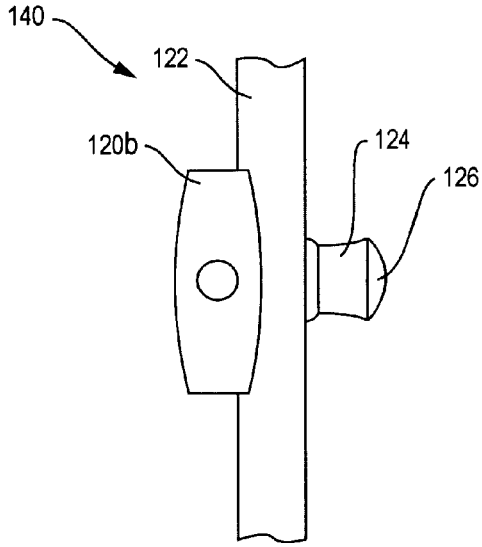

FIG. 4B is an example illustrating a front view 130 of the stringed instrument without the tuner guard installed. FIG. 4C is an example illustrating a side view 140 of the instrument without the tuner guard installed. Elements which are common in the different views of FIGS. 4A, 4B and 4C are similarly numbered. The front view 130 may be the view of the guitar or other stringed instrument when viewing the instrument held by another in the playing position. The head of the tuning peg 120*b* is located on the underside or a surface opposite that of the front view.

Figure 5:
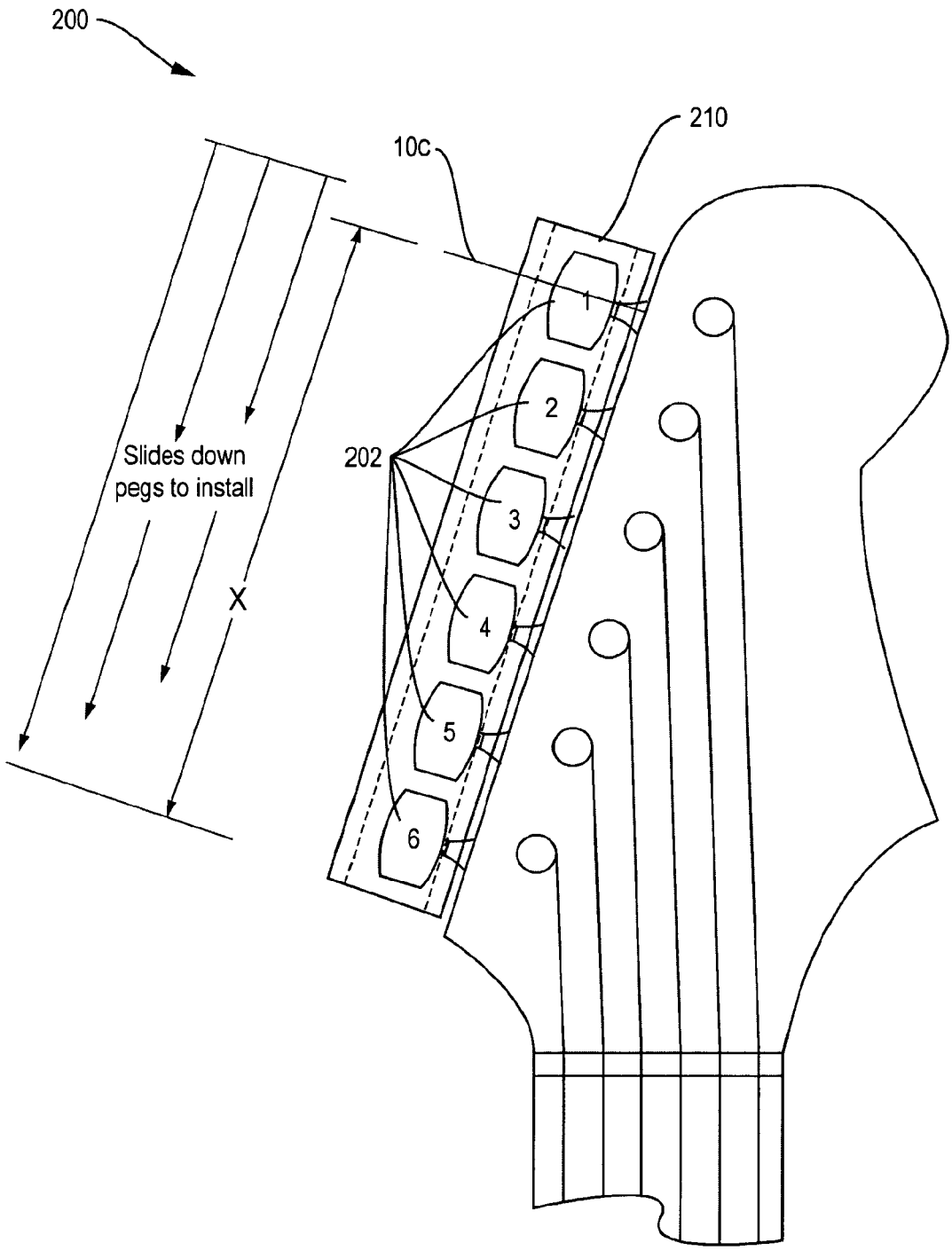
FIG. 5 is an example illustrating an embodiment of a tuner guard installed for use with a 6×1 tuning peg configuration.

Referring to FIG. 5, shown is an example of an embodiment of the tuner guard installed for use with a "6×1" tuning peg configuration. In the example 200, all six tuning pegs are in line with each other. The example 200 represents what is referred to elsewhere herein as a front view of the stringed instrument in connection with FIG. 4B.

In the example 200, the tuner guard 210 is installed in position (as indicated by the directional arrows in the figure) and is transparent for purposes of illustration allowing the tuning pegs 202 to be visible for illustration. The numbers 1-6 on the tuning peg heads represent peg positions. The dotted lines in 210 may represent the thickness of the tuner guard sidewalls. The thickness of the sidewalls may be selected in accordance with the height or length of the tuning peg neck. In this figure and others herein, the tuning pegs may be in an approximate linear arrangement with respect to one another and are shown as having approximately a same rotational position. As known in the art, a tuning peg may be moved in a rotational manner around its center axis to facilitate instrument tuning. Although the FIG. 5 and others herein may illustrate the tuning pegs have approximately the same rotational position, the tuning pegs can be rotated in any position prior to the tuner guard being installed without having to make any adjustments to accommodate usage or installation of the device. All pegs may be fully adjusted so that the instrument is tuned prior to the tuner guard being installed. Once the tuner guard is placed on the tuning pegs, the tuning pegs are secured in position while the tuner guard is in place. The tuner guard can be removed without affecting the tuning or rotation of any tuning pegs by sliding the tuner guard in the opposite linear direction than as described herein for installation and use.

In the example 200, element 10*c* (as also illustrated in other figures herein) may represent an ending position of the slit in the tuner guard 210. Element 10*c* may also represent the position of the tuning peg denoted #1 when the tuner guard is installed so that the peg #1 is flush with the end 10*c* of the slit in the tuner guard. X indicates the distance or length of the slit spanning alongside the tuning pegs and runs the length of the cylindrical tube forming the tuning guard. Peg #6 is the last peg to be covered by the tuner guard during installation. Peg #6 is also the first peg to be exposed when removing the tuning guard. Similarly, peg #1 is the last peg exposed when removing the tuning guard.

Figure 6B:
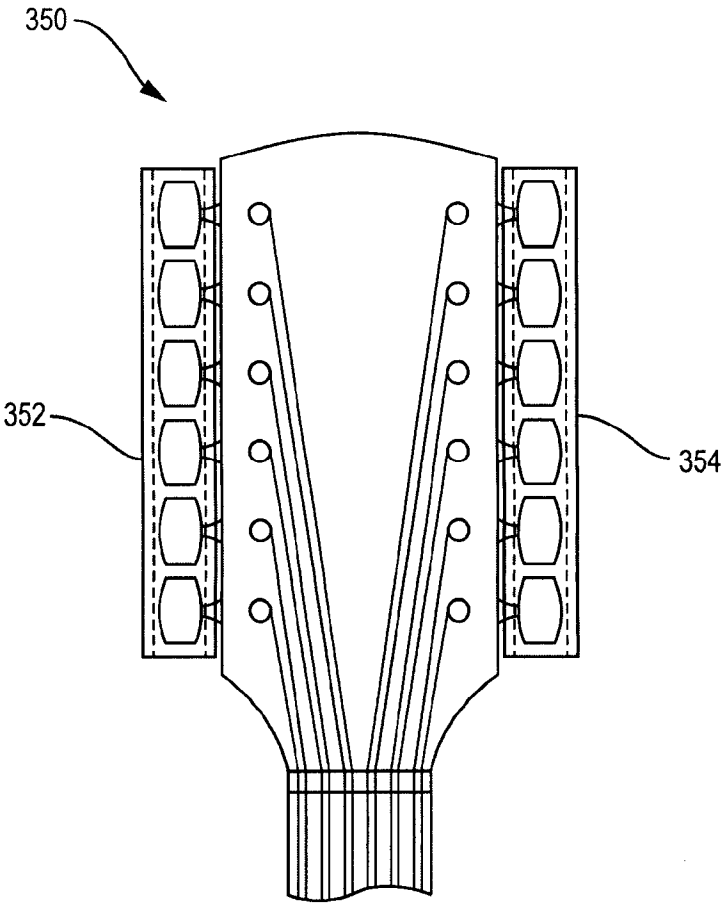
FIG. 6B is an example illustrating an embodiment of multiple timer guards installed for use with a 2×6 tuning peg configuration.
Figure 6A:
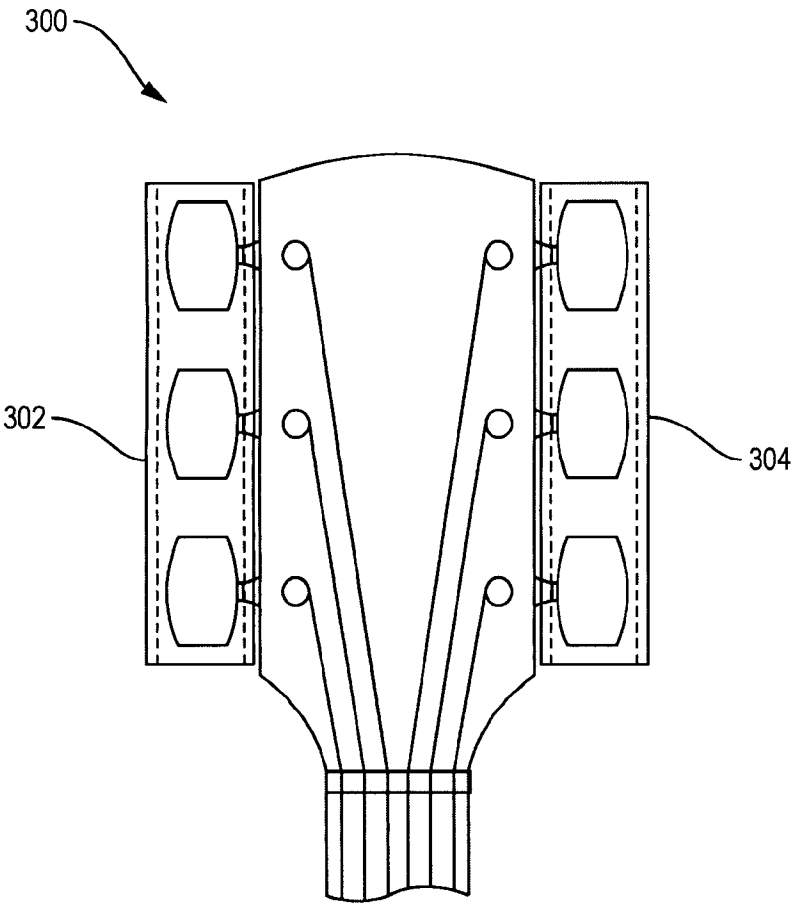
FIG. 6A is an example illustrating an embodiment of multiple tuner guards installed for use with a 2×3 tuning peg configuration.

Referring to FIG. 6A, shown is an example illustrating use of an embodiment of multiple tuner guards with a typical "2×3" peg configuration. In the example 300 with the 2×3 tuner peg configuration, there are 3 pegs are on each side of the stringed instrument. A first tuner guard 302 may be installed and used with a first set of 3 pegs. A second tuner guard 304 may be installed and used with a second set of 3 pegs.

Referring to FIG. 6B, shown is an example illustrating use of an embodiment of multiple tuner guards with a typical "2×6" peg configuration. In the example 350 with the 2×6 tuner peg configuration, there are 6 pegs are on each side of the stringed instrument. A first tuner guard 352 may be installed and used with a first set of 6 pegs. A second tuner guard 354 may be installed and used with a second set of 6 pegs.

Figure 7:
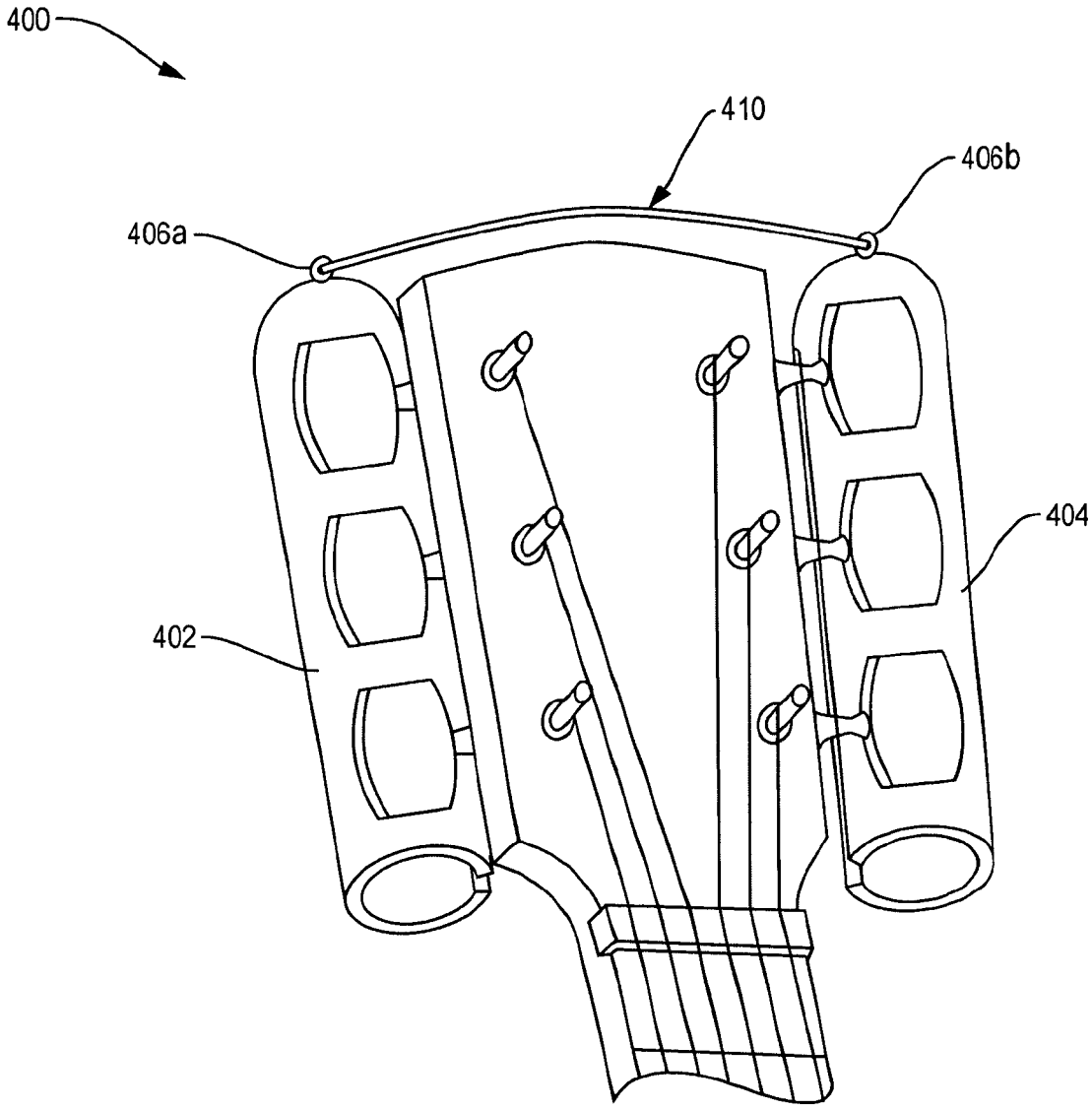
FIG. 7 is an example illustrating another embodiment of multiple tuner guards installed for use with a 2×3 tuning peg configuration utilizing a tethered tuning guard arrangement.

Referring to FIG. 7, shown is an example illustrating use of another embodiment of multiple tuner guards with a 2×3 peg configuration. The example 400 illustrates an embodiment of the multiple tuner guard tubes in a tethered configuration. In this example 400, the tuner guard device comprises 2 tuner guard tubes 402 and 404 tethered together using connection 410. The connection can be made of any one or more materials such as, for example, metal, rubber, nylon, a malleable plastic material, and the like. The materials of 410 may be chained or braided as well as a single or multiple twisted strand arrangement. The connection 410 is coupled to tube 402 at one end 406*a* and is also similarly coupled to tube 404 at one end 406*b*. The connection 410 prevents the tubes 402 and 404 from being separated from one another while in use or storage.

Figure 8:
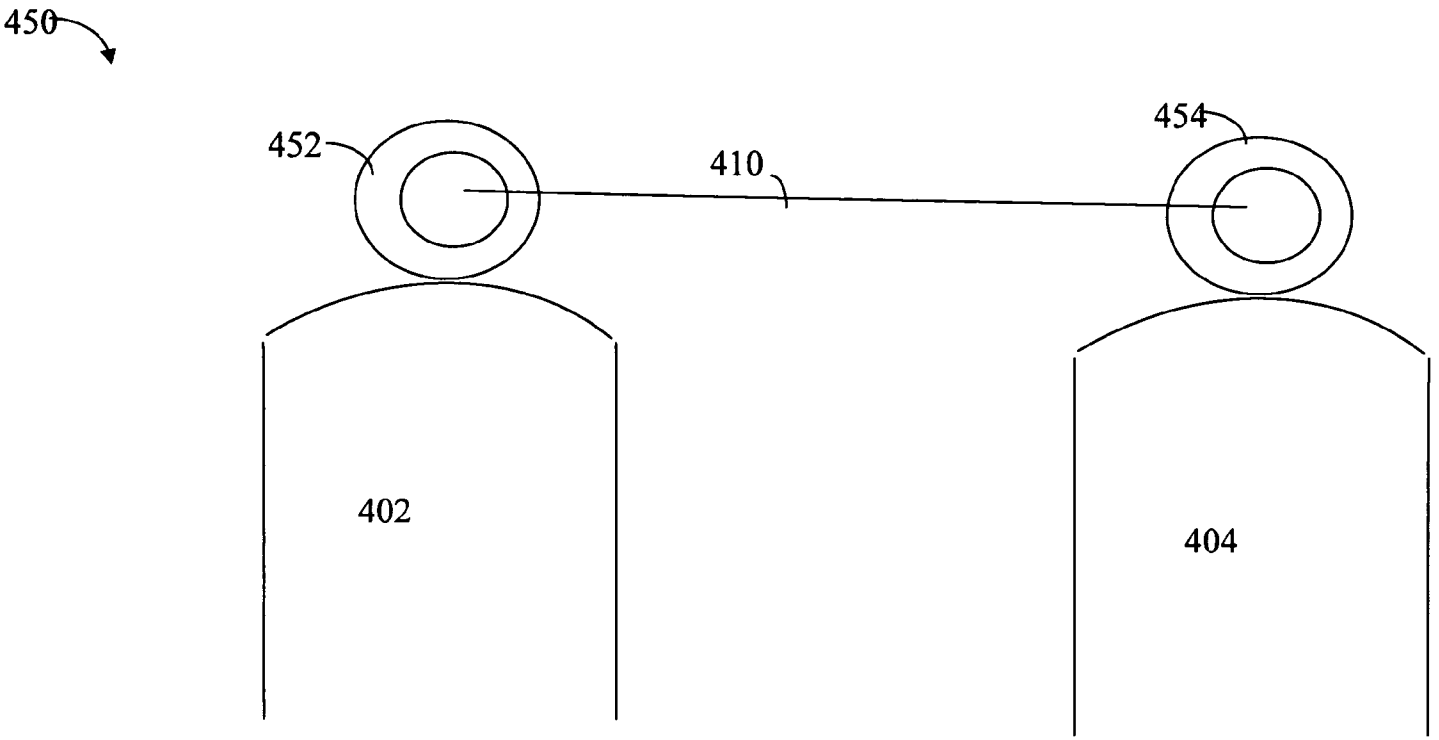
FIG. 8 is an example illustrating in more detail how the multiple tuner guards from FIG. 7 may be connected in the tethered arrangement.

Referring to FIG. 8, shown is an example illustrating in more detail how each of the tuner guard tubes of FIG. 7 may be tethered together. In the example 450, the tube 402 may include a small ring portion 452 to which one end of the connection 410 is attached. The tube 404 may also include a small ring portion 452 to which the other end of the connection 410 is attached. As a further example, the connection 410 may be a braided arrangement of nylon strands that may be looped through the opening of 452 and secured thereto using a knot. The other end of the connection 410 may be similarly secured through the opening of 452.

As a variation to the foregoing, the connection 410 may be a metal chain including a mechanical clasp or fastener at each end. The mechanical clasp at each end may be used to secure the connection to each of 452 and 454. The mechanical clasps at each end may provide for attachment and disconnecting the connection 410 from each of 452 and 454 as desired. As yet a further variation, the connection 410 may be more permanently secured to each of 452 and 454 so that the clasps or fasteners providing for repeated attachment and disconnecting by a user are omitted and the metal chain is directly and permanently coupled to 452 and 454. As yet a further variation, an embodiment may provide an arrangement of the tuner guard in which the connection 410 may be attached and disconnected from one of 452 and 454 but not the other. An embodiment may use other materials for the connection 410 such as, for example, plastic, nylon, rubber, and the like, as well as other materials suitable for use as described herein.

The example 450 is merely one arrangement with described variations by which the two tuner guard tubes 402 and 404 comprising an embodiment of the tuner guard device may be connected together in the tethered option. Alternatively, as also described herein, multiple tuner guard tubes may be utilized without being connected to one another.

Figure 9:
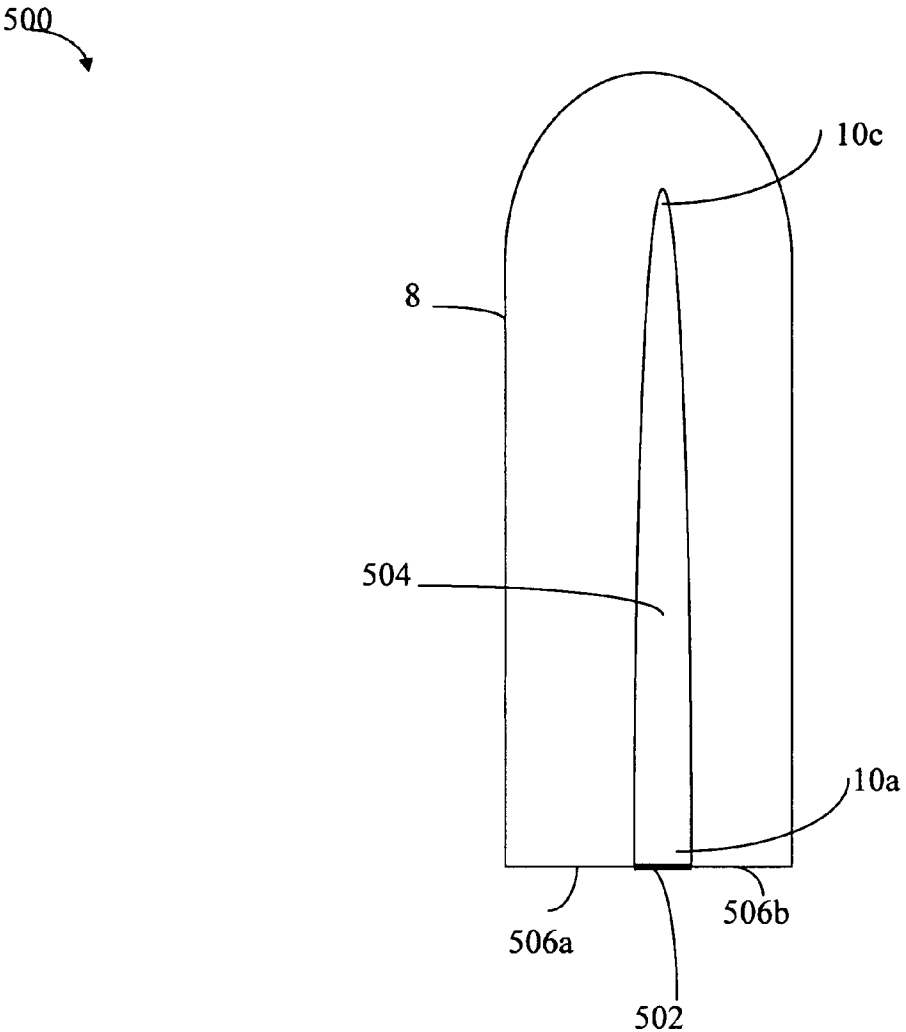
FIG. 9 is an example illustrating a side view of another embodiment of the tuner guard.

With reference back to FIG. 1, it should be noted that FIG. 1 illustrates an embodiment of the tuner guard with an insert portion 10*b* having slit 11 formed therein. The body 8 includes an opening down one side into which the insert portion 10*b* is placed. An embodiment may also omit the insert portion 10*b* from the tuner guard body. In this latter embodiment omitting insert portion 10*b*, the body 8 may include the opening formed therein as just described in the sidewall of the tuner guard body. The tuner guard may be installed for use over the tuning pegs so that the tuning pegs are in direct contact with the tuner guard body. The tuner guard may be installed in a manner similar to as just described herein when the insert portion 10*b* is utilized. FIG. 9 is an example illustrating an embodiment of the tuner guard (tuning pegs not shown) as just described omitting insert portion 10*b* of FIG. 1. The example 500 is a side view of the tuner guard body 8 with the opening 504 in the sidewall having positions 10*a* and 10*c* as described above. The opening 504 formed through the sidewall of the tuner guard body 8 may have dimensions selected in accordance with the size of the tuning peg neck and head so that the body can be positioned over the tuning pegs by sliding as described herein. Such an embodiment in which the insert portion 10*b* is omitted may also optionally include a connection 502 at the end 10*a* connecting sides 506*a* and 506*b* of the opening 504. The connection 502 may be used to secure the tuner guard in the installed position on the tuning pegs. Element 502 may be, for example, one or more strands or a band of material, such as nylon string, rubber, a metal chain, and the like, secured to both sides (506*a* and 506*b*) of the opening 504 at the end 10*a* to prevent the tuner guard from vertical movement or slippage from the installed position. The foregoing slippage may occur, for example, if a guitar is held upside down or otherwise positioned so that end 10*a* is below the horizontal. It should also be noted that the different variations described in connection with the tethering function of FIG. 8 may also be used in connection with element 502.

In connection with figures and illustrative embodiments described herein throughout the description, it should be noted that the dimensions and particular number, shape, and the like, of features provided are examples of ones that may be utilized in an embodiment and should not be construed as a limitation of techniques described herein. The dimensions, measurements, and the like, provided herein are approximate and are in units of inches or degrees unless otherwise specified. The foregoing dimensions, measurements, and the like, may be characterized as about or approximately a particular value in that a degree of error may be expected in connection with obtaining such measurement or dimension and/or producing a device having the specified measurement or dimension. Additionally, it will be appreciated by those skilled in the art that in the event that the dimensions, shapes, and the like, of a tuning peg or other instrument characteristic affecting installation and use of the device embodiments described herein may vary, the particular dimensions, shapes, and the like, of the tuner guard device described herein may also be accordingly varied.

Figure 10:
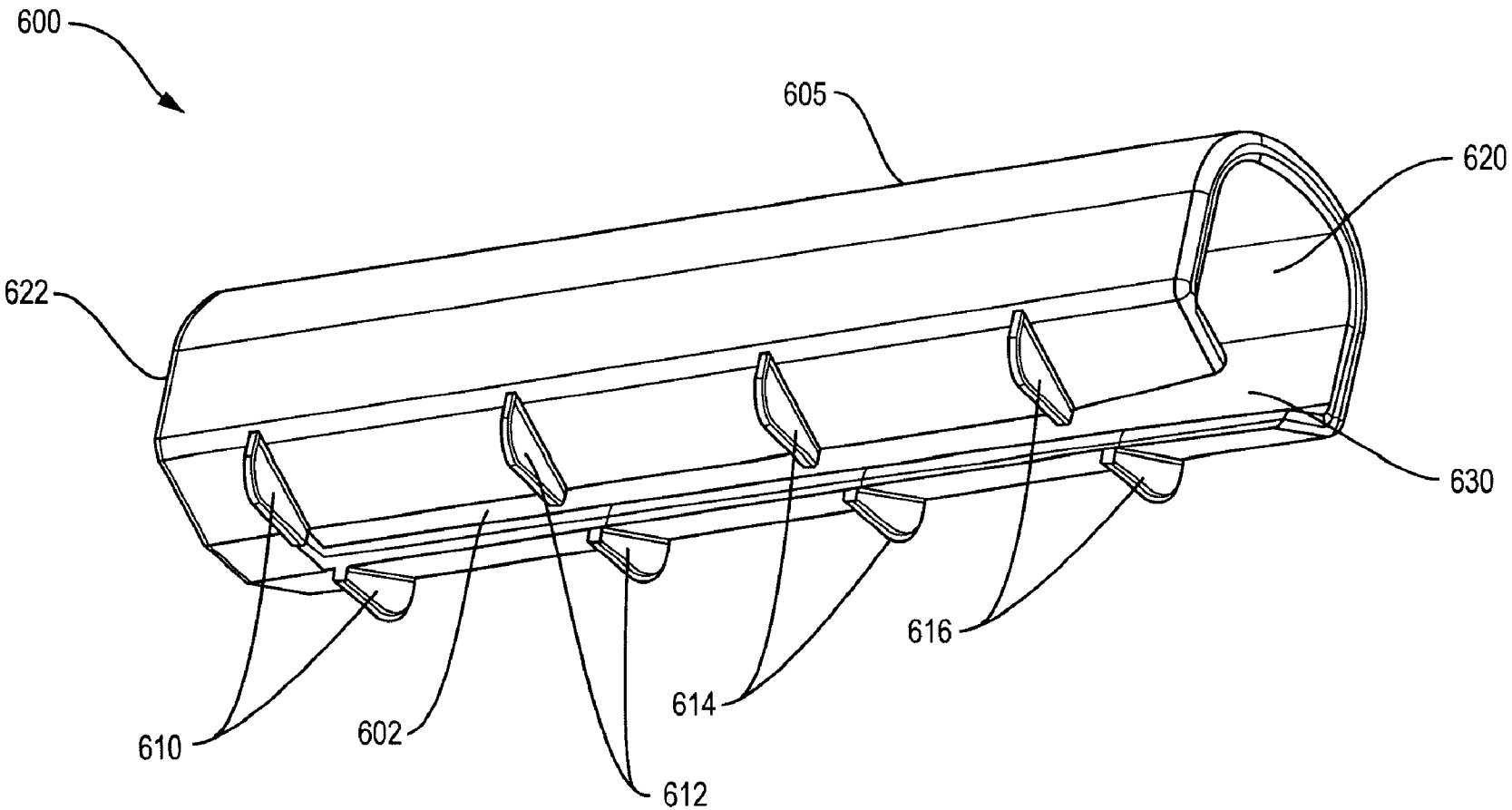
FIG. 10 is an example illustrating a first view of an embodiment of the tuner guard having a first end of the device which is open-ended and a second opposite end which is enclosed.

Referring to FIG. 10, shown is an example illustrating a first view of an embodiment of the tuner guard having a first end of the device which is open-ended and a second opposite end which is enclosed. The example 600 includes the first end 620 of an elongated body 605 forming a sleeve where the first end 620 is open and the second opposing end 622 is enclosed. The profile or cross-sectional view of the body 605 may be characterized as generally oval or elliptical (e.g., see profile at end 620) so as to more closely approximate the outline or shape of a tuning peg to be inserted therein. The embodiment of FIG. 10 includes four pair of feet (also referred to as ribs or gussets) 610, 612, 614, and 616 at a bottom surface of the body. The feet functionally serve as an anti-rotational feature or element which provides increased stability to keep the tuner guard from rotating when installed. The feet 610, 612, 614 and 616 also facilitate use of the tuner guard on different models of instruments and pegs having varying dimensions. The feet also add to the rigidity and durability of the device. The feet may be shaped to have a curved edge portion extending outward away from the external tuner guard walls. The embodiment illustrated in 600 may also include a slit 602 in the bottom portion of the illustrated device where the slit 602 has a tapered opening at one end as illustrated by 630. The opening 630 at end 620 is the point where the device is first installed onto the tuning pegs. In one embodiment, the slit may be tapered for a 1-inch portion, such as from the position of the last pair of feet 616 to the end 630. The tapering along such a 1-inch portion may increase the slit width from the position of 616 to the end 630. Having such a tapered slit at the opening 630 for the one-inch portion may facilitate installation and/or removal of the device with respect to the tuning pegs. Further details regarding the illustrated example 600 of FIG. 10 are provided below.

Figure 11:
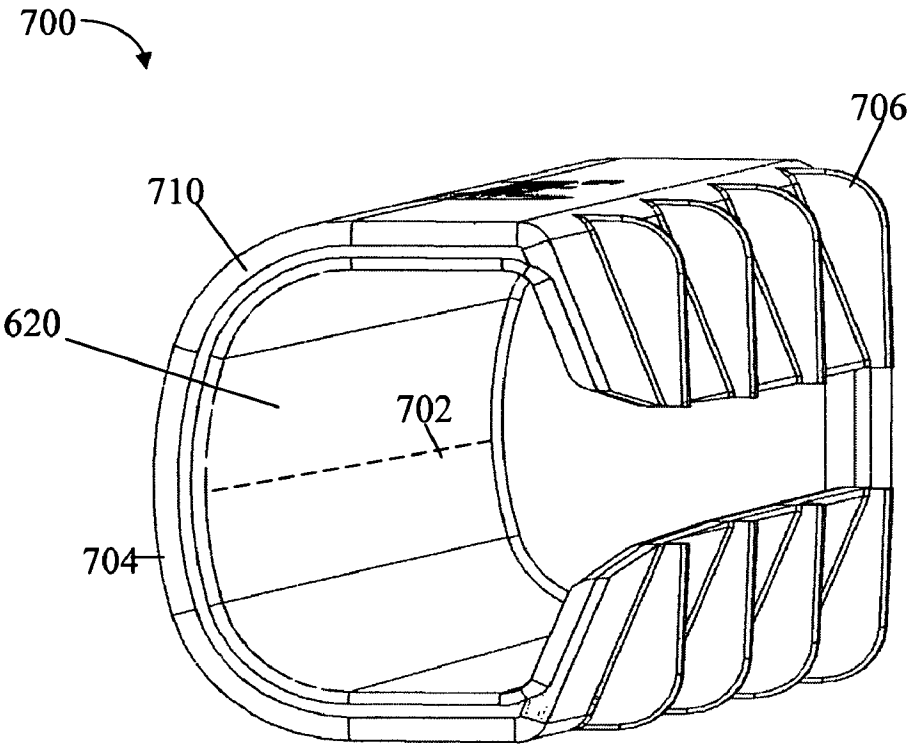
FIG. 11 is an example of a second view of an embodiment of the tuner guard of FIG. 10.

Referring to FIG. 11, shown is an example of a second view of an embodiment of the tuner guard of FIG. 10 with the open end 620 facing. Element 706 illustrates the curved edge portion of one of the feet. It should be noted that the surface of 710 (outer surface at facing end of the illustrated device) may be any shape such as flat or curved.

Figure 12A:
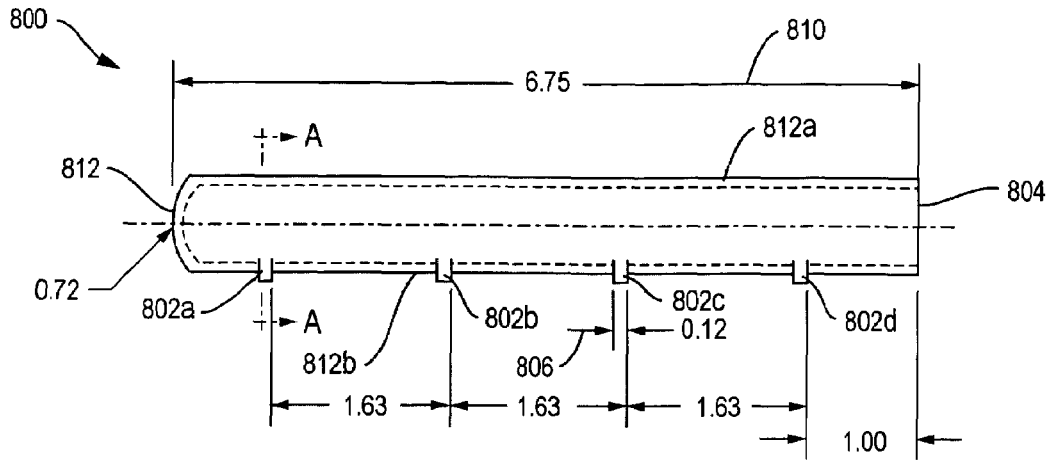
FIG. 12A is an example illustrating a side view of the embodiment of FIG. 10 with additional detail.

Referring to FIG. 12A, shown is an example illustrating a side view of the embodiment of FIG. 10 with additional detail. The example 800 illustrates points 802*a*-802*d* where each of the pairs of gussets or feet may be positioned. In this example, the pairs of gusset or feet (4 in this example) at illustrated points 802*a*-802*d* are spaced approximately every 1.63 inches so that each pair of feet are spaced approximately equidistant from other pairs of neighboring feet. The pair of feet 802*d* closest to the open end 804 may be positioned approximately 1.0 inch from the end 804. As described above in connection with FIG. 10, the slit or opening into which the tuning pegs are inserted during device installation may be tapered outwardly for a 1-inch portion defined from the position of the last pair of gusset or feet at point 802*d* to the open end 804 of the device. Each of the gusset or feet may have a width or thickness dimension 806 (in the illustrated side view) of approximately 0.12 inches. The length of the tuner guard measured as illustrated by 810 from one end to another may be 6.75 inches. The enclosed end of the tuner guard body illustrated by 812 may be characterized as dome-shaped or slightly rounded at the enclosed end. The enclosed rounded end as represented by 812 may have, for example, a radius of 0.72 inches as the rounded end transitions with respect to the upper and lower horizontal walls 812*a* and 812*b*.

Figure 12B:
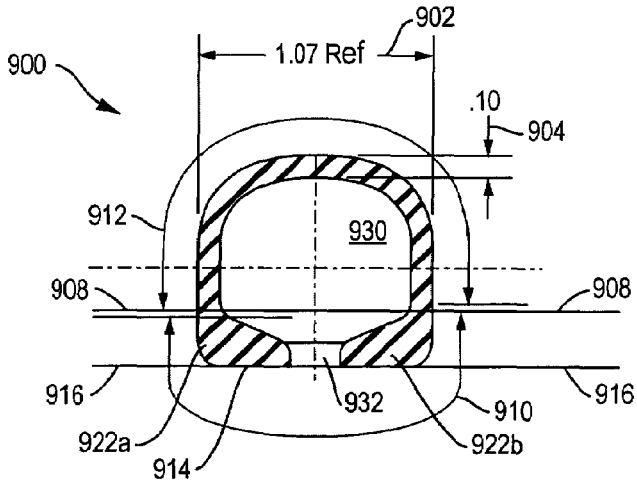
FIG. 12B is a an example illustrating a cross sectional view of FIG. 12A taken along lines A-A in one embodiment.
Figure 12C:
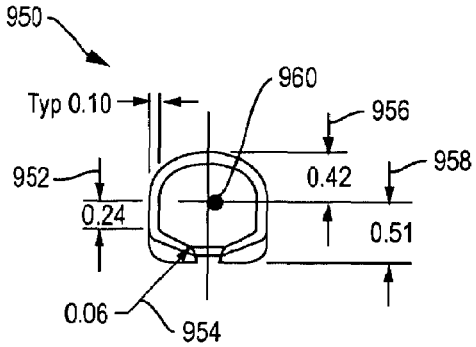
FIG. 12C is an example illustrating in more detail the cross-sectional view of FIG. 12B in one embodiment.
Figure 12D:
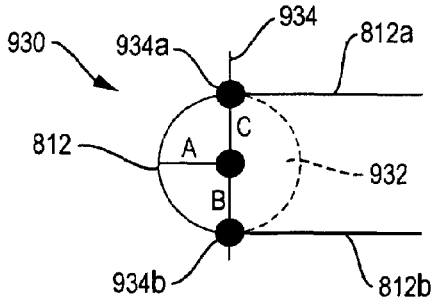
FIG. 12D is an example illustrating in more detail an enclosed end portion of one embodiment of the tuner guard.

Referring to FIG. 12D, shown is an example illustrating in more detail the rounded enclosed end 812 as may be included in one embodiment of the tuner guard device. The example 930 includes the rounded enclosed end portion 812 illustrating that the radius measurement of 0.72 inches may represent the radius formed with respect to the imaginary circle 932. Thus, the lines denoted as A, B and C may approximate 0.72 inches. Element 934 represents a vertical line (including portions thereof denoted A and B, each of which represent a radius of the circle 932) connecting points 934*a* and 934*b*, respectively, on walls 812*a* and 812*b*. Points 934*a* and 934*b* represent approximately where the curving or rounding of the end portion 812 occurs or begins with respect to transitioning from the horizontal orientation of walls 812*a* and 812*b*.

It should be noted that, as with other embodiments described herein, although the device is illustrated as having an enclosed end 812 with a rounded end, it will be appreciated by those skilled in the art that an embodiment may have utilize different variations of the end 812. For example, the enclosed end 812 may have a different shape which is not rounded but is rather squarish or approximates another shape. The end 812 may not be enclosed but may rather be open in a manner similar to that as illustrated by opening 804 at the end opposite 812.

Referring to FIG. 12B, shown is an example illustrating a cross sectional view of FIG. 12A taken along lines A-A in one embodiment. The view along A-A is taken along a point of the tuner guard where feet are positioned at 802*a*. The tuner guard wall thickness for the shaded portion corresponding to element 912 extending in a semi-circular fashion above the horizontal line denoted by 908 may have an approximate uniform thickness of 0.10 inches. The shaded portion corresponding to element 910 extending in a semi-circular fashion below the horizontal line denoted by 908 represents the cross-sectional view of the feet in combination with the remaining portion of the tuner guard wall extending below the horizontal line represented by 908. The remaining portion of the tuner guard wall included in the shaded portion extending below the horizontal line represented by 908 may vary in thickness as will be illustrated and described in more detail below. The horizontal distance represented by 902 between external or outside walls of the tuner guard may measure 1.07 inches. The feet 922*a*, 922*b* may be shaped to have a curved outer portion as also illustrated and described above in connection with FIGS. 10 and 11. The bottom portion 914 of the feet may be formed to have an approximately flat surface conforming to the horizontal line or plane as represented by 916. The bottoms of all feet of the device body may substantially conform to the same horizontal plane.

It should be noted that although the anti-rotational elements illustrated in FIG. 12B are pairs of feet having particular features such as flat bottom portions 914, other variations and designs thereof are possible in connection with providing the anti-rotational function. The feet may prevent rotation of the body, for example, by having the bottom portion 914 of the feet on one side of the device come into contact with a surface of the head or stock of the instrument when forces are exerted on the device to try and rotate the device with respect to its center axis. For example, with reference back to FIG. 4A with the embodiment of the device as illustrated in FIGS. 10, 11, and 12A-12C, when the device is rotated in a counter-clock-wise manner, the feet of the device will come into contact with the guitar neck.

It should also be noted that the profile or shape of the opening 930 in the body may be configured to have sufficient dimensions and size in accordance with a tuning peg profile or cross-sectional view. Similarly, the dimensions of the tuning peg neck may be considered in connection with configuration of the slit size 932. The foregoing may be considered so that the body of the device may accommodate tuning pegs of the stringed instrument to be used with the device.

Referring to FIG. 12C, shown is an example illustrating in more detail the cross-sectional view of FIG. 12B in one embodiment. Element 960 may represent the center of the tuner guard with respect to the horizontal and vertical axes thereof. The length of the wall segment represented by 952 may be 0.24 inches. The thickness of the tuner guard wall at point 954 at the edge of the slit in the bottom of the tuner guard may be approximately 0.06 inches. Element 956 may represent the length of 0.42 inches as measured from the external or outside tuner guard wall at the top of the device to the horizontal plane passing through point 960. Element 958 may represent the length of 0.51 inches as measured from the horizontal plane passing through point 960 to the horizontal plane of the bottom portion of the feet (e.g., as represented by 916 in FIG. 12B).

Figure 13A:
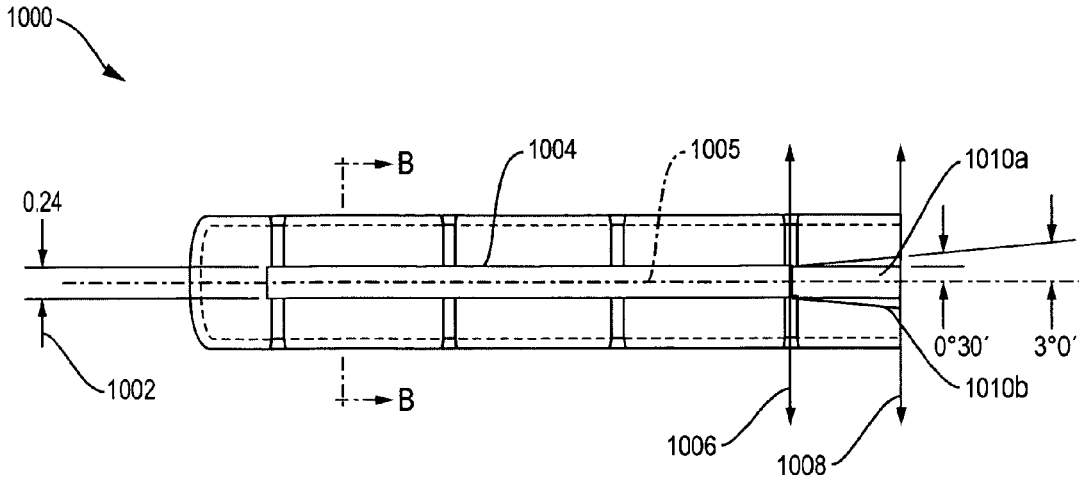
FIG. 13A is an example of a bottom view of the embodiment of FIG. 10 illustrating the slit or opening in the tuner guard with additional detail.

Referring to FIG. 13A, shown is an example of a bottom view of the embodiment of FIG. 10 illustrating the slit or opening in the tuner guard with additional detail. The example 1000 illustrates a slit or opening 1004 into which the tuning pegs are inserted during installation. The slit 1004 has an approximate width measurement of 0.24 inches as illustrated by 1002 at a closed end of the slit 1004. The slit 1004 may have an approximately uniform width, such as of 0.24 inches, from the end of the slit illustrated by 1002 to the point 1006 where a set of feet are positioned (the set of feet closest to the open end 1008 of the slit). From point 1006 to the point 1008 at the open end of the slit 1004, the width of the slit may increase so that the slit is tapered. As described elsewhere herein, the distance from 1006 to 1008 may measure approximately 1 inch. The width of the slit 1004 may increase from 0.24 inches at point 1006 to approximately 0.30 inches at point 1008. Each of the inner walls 1010*a* and 101*b* of the slit may be tapered at an angle of approximately three (3) degrees with respect to the center axis 1005 of the device.

It should be noted that the slit width of approximately 0.24 inches may be selected in accordance with an average or expected diameter of the neck of the tuning peg to be used with the device. For example, in connection with the one illustrated embodiment, an average or expected width or diameter of the tuning peck neck is 0.24 inches and the slit width at the untapered end 1002 up point 1006 may also be 0.24 inches so as to approximate the size of the tuning peg neck.

Figure 13B:
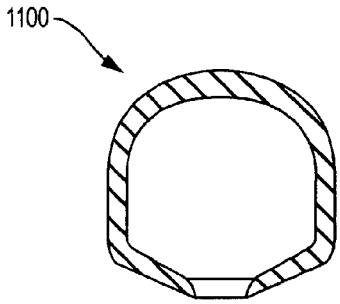
FIG. 13B is a an example illustrating a cross sectional view of FIG. 13A taken along lines B-B in one embodiment.

Referring to FIG. 13B, shown is an example illustrating a cross sectional view of FIG. 13A taken along lines B-B in one embodiment. The cross sectional view is taken at a point along the tuner guard wall where there are no feet or gussets. The shaded portion in the example 1100 represents the thickness of the tuner guard wall. Additional detail of FIG. 13B is illustrated and described in connection with FIG. 13C and FIG. 14.

Figure 13C:
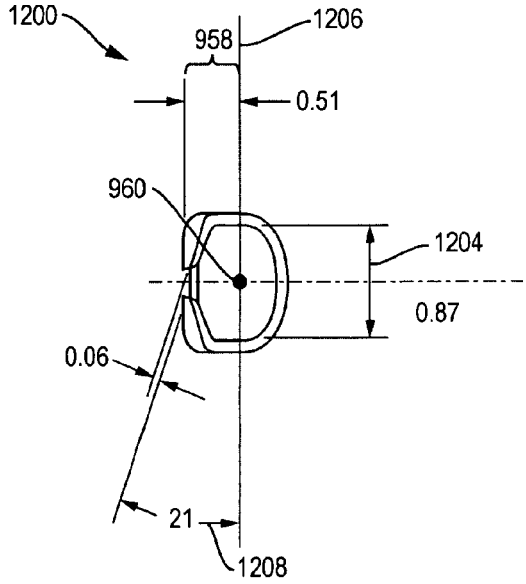
FIG. 13C is an example illustrating in more detail the cross-sectional view of FIG. 13B in one embodiment.
Figure 14:
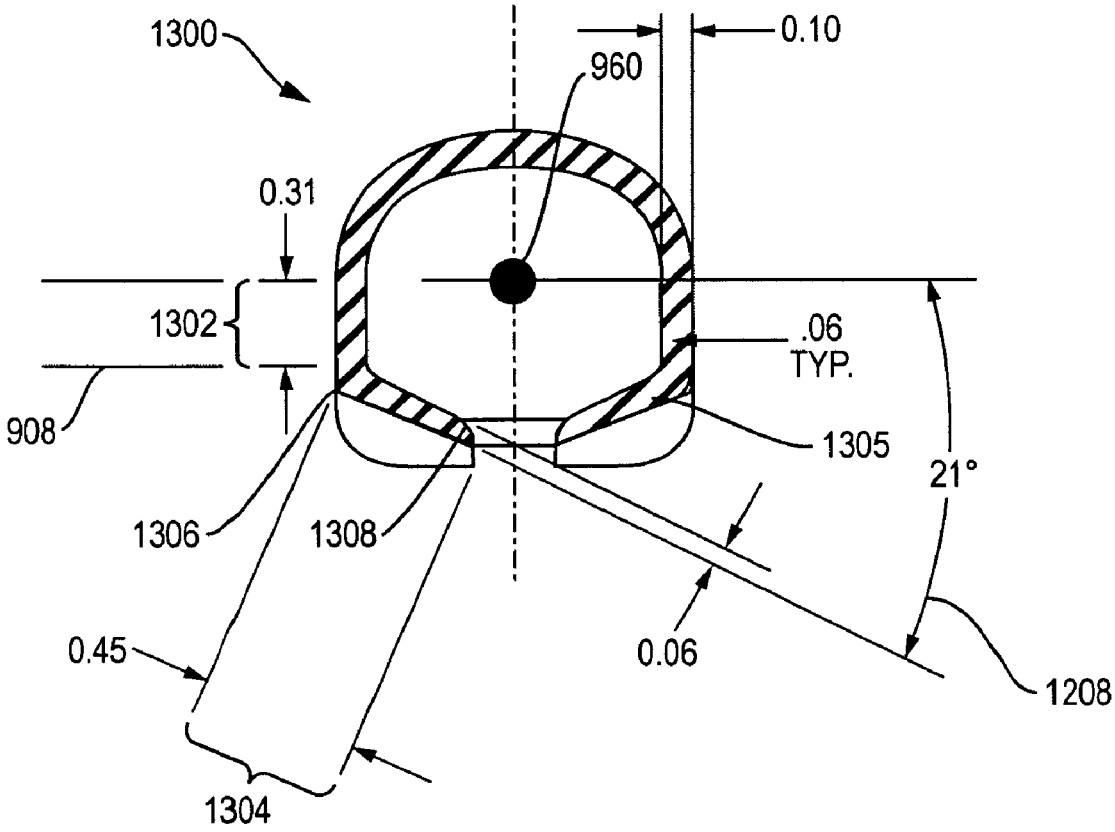
FIG. 14 is an example illustrating in more detail the cross-sectional view of FIG. 13B in one embodiment.

Referring to FIG. 13C, shown is an example illustrating in more detail the cross-sectional view of FIG. 13B in one embodiment. Element 1204 represents the distance of 0.87 inches as may be measured from the inside or inner walls of the tuner guard through the vertical plane as illustrated by line 1206 through the center point 960. Element 1208 may represent the angular measurement of 21 degrees with respect to the illustrated lines Referring to FIG. 14, shown is an example illustrating in more detail the cross-sectional view of FIG. 13B and FIG. 13C in one embodiment. The tuner guard wall portion indicated by element 1302 may have a length measuring 0.31 inches. The tuner guard wall portion indicated by element 1304 may have a length measuring 0.45 inches and a thickness which decreases from 0.10 inches at point 1306 to 0.06 inches at point 1308. In this illustrated embodiment, the edge of the slit at point 1308 may also be further tapered in a curved manner. It should be noted that the reference to "0.06 Typ" in the figure indicates that the width of the wall of 0.06 inches at the slit opening, as well as other dimensions, apply to the wall of the device with respect to both sides of the slit opening in a symmetrical fashion.

In connection with FIG. 14, it should be noted that the device wall thickness variation and tapering or decreasing from point 1306 to 1308 is illustrated with respect to one segment 1304 at one edge of the slit. The segment 1305 is also designed in a manner similar to that as described with respect to element 1304 to have thicknesses which are approximately the same as those as element 1304 at different points therein.

In connection with the embodiments described in FIGS. 10, 11, 12A-C, 13A-C and 14, the desired frictional qualities necessary to hold the device in its installed position on a particular instrument may be provided as a result one or more of the features of the device described herein such as, for example, as a result of one or more of the following: the material used, such as TPE, the durometer reading of the final cured device, the selected width of the slit in the device body with respect to the diameter of a tuning peg neck, and the tapering of the thickness of the tuner guard wall in a decreasing manner for a portion of the wall extending toward the slit into which the pegs are inserted. It should be noted that the embodiments described in FIGS. 10, 11, 12A-C, 13A-C and 14 do not include a separate portion, such as element 10*b* of FIG. 1, nor is a connection element 502 of FIG. 10 needed to hold the tuner guard in place. The desired frictional properties to facilitate holding an installed device on an instrument may be obtained as a result of features as described herein. With respect to the feature of wall thickness, such as varying from point 1306 to point 1308 on both sides of the slit, the dimensional variations of the wall thickness (e.g., decreasing wall thickness from 1306 to 1308) allow for mechanical flexibility of the device. Such mechanical flexibility facilitates used of the device with pegs having varying neck sizes with respect to the slit opening width while also providing the desired frictional qualities and snugness of fit of the slit around the peg neck when the device is installed. For example, with respect to the illustrated embodiment described above with a slit width of 0.24 inches (e.g., such as for the untapered portion between 1002 and 1006 with reference to FIG. 13A), the device may accommodate tuning peg necks having a diameter or width equal to that of the slit width of approximately 0.24 inches as well as those peg necks having a diameter or width that may be larger or smaller than the slit width in an embodiment. Flexibility of the device, such as with respect to the slit opening, may be desired because variations in tuning peg size and dimensions may be expected with different manufacturers and designs of tuning pegs. The inventors have found that a device having a particular slit width for the untapered portion work best with tuning pegs having a peg neck diameter which approximates the size of the slit width of the untapered portion thereof.

An embodiment of the tuner guard described herein may be formed using any suitable technique and material. As a further example, an embodiment of the device as illustrated in connection with FIG. 10 may be formed from a thermoplastic material such as a thermo-plastic elastomer (TPE), urethane, or a similar polymer material. The device may be formed using injection molding. For example, one way in which the device may be produced utilizes a two-piece injection molded cavity design where the mold is formed from two portions which, when placed together, form the desired cavity for molding the device. With reference back to FIG. 11, the two pieces of the mold may form a cavity which is split or separated as illustrated by the horizontal plane passing through line 702 (extending into the slit where the pegs are inserted during installation). A seam created in the top portion 704 of the device by using such a two piece mold may not be visible to the human eye. The cavity of the mold may be filled, for example, using a cold runner or a hot runner injection molding process as well as other suitable molding techniques known in the art. The device may be removed from the mold when cured for a sufficient time in accordance with the particular method and material utilized. At the end of the curing time, the durometer reading may be, for example, in the range of 75-90, inclusively, for a device formed from TPE. In one embodiment in which a cold-runner injection molding process is used, the time (including injection and curing time to obtain a durometer reading of 75-90 for a device formed from TPE) may be, for example, 40 seconds. The foregoing durometer reading of 75-90 may be made using a Shore D durometer in accordance with hardness testing as defined by the ASTM standard, ASTM D2240-05 Standard Test Method for Rubber Property—Durometer Hardness. Such standards as provided by ASTM are known in the art. ASTM (ASTM International) is also known as the American Society for Testing and Materials which is an international standards organization that develops and publishes voluntary consensus technical standards for a wide range of materials, products, systems, and services.

As also known to those skilled in the art, a durometer is an instrument which is used to perform a hardness test on different materials. The durometer measurement is dimensionless and may rather be characterized as representing a scaled value from 0-100 denoting a relative hardness for the particular scale utilized for a material where higher measurements indicate harder materials. As described above, the durometer reading of 70-90 may be made with a Shore D durometer. As will also be appreciated by those skilled in the art, the D indicates a particular scale used in providing the indicated hardness measurement.

The foregoing describes embodiments of a tuner guard that may be used to prevent the inadvertent (accidental) movement of tuning keys on stringed instruments during transport and storage such as, for example, in soft cases. Furthermore, the tuner guard may be easily placed on a tuned instrument and then subsequently easily removed for retuning, playing and, other subsequent uses. The tuner guard may also remain in place (installed) while an instrument is played.

It should be noted that the tuner guard embodiments described herein are illustrated as being tube-like and/or having a circular cross section. It will be appreciated that other cross sectional shapes, such as elliptical, rectangular, and the like, may be used in an embodiment. With respect to the various embodiment in the foregoing figures, such as for example FIG. 1 and FIG. 10, the tuner guard may be characterized as having an elongated body forming a sleeve with a slit formed therein extending along a side of the body and having a length selected in accordance with the length of the tuning pegs on the instrument where the device is to be installed. The body may have a shape and dimensions in accordance with a shape and dimensions of a row of a plurality of tuning pegs of the stringed instrument so that the body is configured to enclose therein head portions of the tuning pegs. The slit is configured to have a length and width to extend around neck portions of the tuning pegs on the stringed instrument.

While the invention has been disclosed in connection with preferred embodiments shown and described in detail, their modifications and improvements thereon will become readily apparent to those skilled in the art.

What is claimed is:

1. A device for preventing movement of tuning pegs on a stringed instrument, the device comprising:

an elongated body forming a sleeve opened at a first end thereof and having a slit formed therein, said body having a shape and dimensions in accordance with a shape and dimensions of a row of a plurality of tuning pegs of the stringed instrument so that said body is configured to enclose therein head portions of said plurality of tuning pegs, said slit configured to have a length and width to extend around neck portions of said plurality of tuning pegs on the stringed instrument.

2. The device of claim 1, wherein said body is enclosed at a second end thereof opposite said first end.

3. The device of claim 1, wherein said body has a cross-sectional profile which is one of generally circular or elliptical.

4. The device of claim 1, wherein a portion of said slit is tapered to increase in width for a length of said portion, said portion extending from a first point in the slit to said first end.

5. The device of claim 4, wherein said length of said portion of said slit is approximately 1 inch.

6. The device of claim 4, wherein said width of said portion at said first point is approximately 0.24 inches.

7. The device of claim 1, wherein said slit is configured with a malleable material running said length of said slit at an inner portion of said slit, said malleable material being in contact with the tuning pegs of the stringed instrument when the device is installed on the stringed instrument.

8. The device of claim 1, wherein said body is open at a second end thereof opposite said first end.

9. The device of claim 1, wherein said device further comprises:

a plurality of pairs of feet extending from the body.

10. The device of claim 9, wherein said plurality of pairs of feet are configured to have bottom portions which are substantially in a same plane.

11. The device of claim 9, wherein each of said plurality of pairs of feet are spaced approximately equidistant from one another.

12. The device of claim 1, wherein said device is made of one or more materials including a thermo-plastic elastomer.

13. The device of claim 1, wherein a wall of said body includes a first portion extending from a first point to a second point at an edge of said slit, and wherein said wall decreases in thickness from said first point to said second point.

14. The device of claim 13, wherein a thickness of said wall at said first point is approximately 0.10 inches and a thickness of said wall at said second point is approximately 0.06 inches.

15. The device of claim 13, wherein said wall includes said first portion with respect a first edge of said slit and said wall includes a second portion with respect to a second edge of said slit opposing said first edge, said second portion extending from a third point to a fourth point at said second edge of said slit, wherein said wall decreases in thickness from said third point to said fourth point, a thickness of said wall at said first point and said third point being approximately the same and a thickness of said wall at said second point and said fourth being approximately the same.

16. The device of claim 15, wherein said wall has approximately a uniform thickness except for said first portion thereof and said second portion thereof.

17. The device of claim 1, wherein said length of said slit is less than a length of said body.

18. The device of claim 12, wherein said device has a hardness in accordance with a durometer reading of between 75 and 90, inclusively.

* * * * *